US005929398A

United States Patent [19]

Amino et al.

[11] Patent Number: 5,929,398

[45] Date of Patent: Jul. 27, 1999

[54] MUFFLER DEVICE

[75] Inventors: Hideo Amino; Kazuaki Furukawa, both of Saitama, Japan

[73] Assignee: Honda Giken Kogyo Kabushiki Kaisha, Tokyo, Japan

[21] Appl. No.: 09/031,676

[22] Filed: Feb. 27, 1998

[30] Foreign Application Priority Data

Mar. 7, 1997 [JP] Japan ..... 9-052877

[51] Int. Cl.[6] ..... F01N 1/08

[52] U.S. Cl. ..... 181/272; 181/265; 181/238; 181/228

[58] Field of Search ..... 181/227, 228, 181/238, 239, 264, 265, 266, 267, 269, 272, 281, 282

[56] References Cited

U.S. PATENT DOCUMENTS

| | | | |
|---|---|---|---|
| 1,988,048 | 1/1935 | Peik | 181/265 |
| 2,009,343 | 7/1935 | Peik | 181/265 |
| 4,416,350 | 11/1983 | Hayashi | 181/272 |
| 5,608,194 | 3/1997 | Okazaki et al. | 181/272 |

OTHER PUBLICATIONS

Japanese Utility Model Laid–Open No. JP–U–56–83622 ; Muffler Device of Internal Combustion Engine ; Publication date Jul. 6, 1981.

*Primary Examiner*—Khanh Dang
*Attorney, Agent, or Firm*—Birch, Stewart, Kolasch & Birch, LLP

[57] ABSTRACT

A small-sized muffler having porous partition walls includes a first expansion chamber, a second expansion chamber, a third expansion chamber and a fourth expansion chamber. A first porous partition wall is longitudinally arranged within the third expansion chamber so as to define a fifth expansion chamber. Similarly, a second porous partition wall is longitudinally arranged within the first expansion chamber so as to define the sixth expansion chamber. The first porous partition wall and the second porous partition wall are provided with small holes over their entire surface. The first porous partition wall and the second porous partition wall are each formed as a convexly curved surface curved toward the center of the muffler around the first feeding pipe and the second feeding pipe, respectively.

20 Claims, 6 Drawing Sheets

MUFFLER DEVICE

BACKGROUND OF THE INVENTION

1. Field of the Invention

This invention relates to a muffler device for an internal combustion engine, and more particularly, to a muffler having a porous partition wall arranged therein. 2. Description of the Background Art Japanese Utility-Model Laid-Open No. Sho 56-83622 discloses a muffler device in which an inner side of the muffler is partitioned by a plurality of partition walls to form a plurality of expansion chambers in a lengthwise direction. Each of the expansion chambers communicates with a communicating pipe. At the same time, a porous partition wall is arranged near an outlet port of a feeding pipe communicating with the exhaust pipe.

In the above embodiment, when a certain distance is not maintained between an outlet of the feeding pipe and the porous partition wall, an undesirable influence may occur hindering the efficient flow of exhaust. Although the porous partition wall is arranged at a right angle with respect to an axial line of the feeding pipe, the outlet port of the feeding pipe cannot be arranged near the porous partition wall by an amount more than a specified distance. Therefore, the size of the muffler must be increased.

When the feeding pipe and the communicating pipe are overlapped with one another, the porous partition wall must be bent in order to be arranged between the feeding pipe and the communicating pipe. The result is that a shape of the porous partition wall may become complicated.

When a plurality of feeding pipes or communicating pipes are present near or passing through the porous partition wall, an extending position of each of the pipes on the porous partition wall must avoid formation of some small holes. Thus, as the number of feeding pipes or communicating pipes is increased, a range of small holes which can be formed at the porous partition wall is limited, and an opening area of the small holes is reduced.

However, if each of the aforesaid problems is to be resolved concurrently, the structure inside of the muffler may become complicated. A degree of freedom in layout about the porous partition wall, feeding pipe, communicating pipe and partition wall is remarkably restricted.

SUMMARY OF THE INVENTION

In order to solve the aforesaid problems, the muffler device of the present invention includes a muffler communicating with an exhaust pipe of an internal combustion engine. An inner side of the muffler is partitioned by partition walls to make a plurality of expansion chambers. The expansion chambers are interconnected with communicating pipes. A porous partition wall is arranged near an outlet port of a feeding pipe continuous with the exhaust pipe. The porous wall is arranged within the expansion chambers substantially in parallel with the feeding pipe.

In the present invention, it is possible to arrange the porous partition wall so as to enclose the outer circumference of the feeding pipe. Further, in this case, it is also possible to curve the porous partition wall toward the center of the muffler.

A plurality of feeding pipes and partition walls may be arranged inside of the muffler. Since the porous partition walls are arranged within the expansion chambers in parallel with the feeding pipes, the inner sides of the expansion chambers are partitioned by the porous partition walls into a plurality of sub-chambers. In this specification, this dividing form is defined as a longitudinal division, and an arranging form of the porous partition wall is defined as a longitudinal setting.

Because of this arrangement, it is not necessary to arrange the porous partition walls a predetermined distance away from the outlets of the feeding pipes. The result is that the entire muffler can be made short in length and its size can be made small.

Additionally, since the porous partition walls are arranged in parallel with the feeding pipes, the shape of the porous partition walls can be simplified. Even in an arrangement where the feeding pipes and the communicating pipes are overlapped with one another, it is not necessary to form the porous partition wall into a complex shape.

Also, since the feeding pipes or communicating pipes do not pass through the porous partition walls, and the porous partition walls are not positioned on extended lines of these pipes, it is possible to form some small holes on substantially the entire porous partition wall to insure sufficient opening area over the entire porous partition wall.

Accordingly, irrespective of the fact that each of the aforesaid problems can be solved concurrently, the structure within the muffler can be simplified and a restriction of layout in regard to the porous partition wall, feeding pipes, communicating pipes and partition wall is reduced, resulting in that a degree of freedom in regard to the layout of the component elements in the internal structure of the muffler is also increased.

Further, if the porous partition walls are arranged to enclose the feeding pipes, the porous partition walls can be made relatively small in size. In addition, even in the case where a plurality of feeding pipes or communicating pipes are present to cause a certain restriction in arranging space, they may be arranged in a relative easy manner.

Further, if the porous partition wall is bent in a convex shape to project toward a center of the muffler, the porous partition wall can be made smaller, resulting in that a space enclosed by the porous partition wall can be made as small as possible. In addition, the curved arrangement of the wall allows it to be arranged in a narrow space more easily. Its rigidity is also increased, resulting in that its anti-vibrating characteristic is also improved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitive of the present invention, and wherein.

DETAILED DESCRIPTION OF THE PREFERRED EMBODIMENTS

Figure 1:
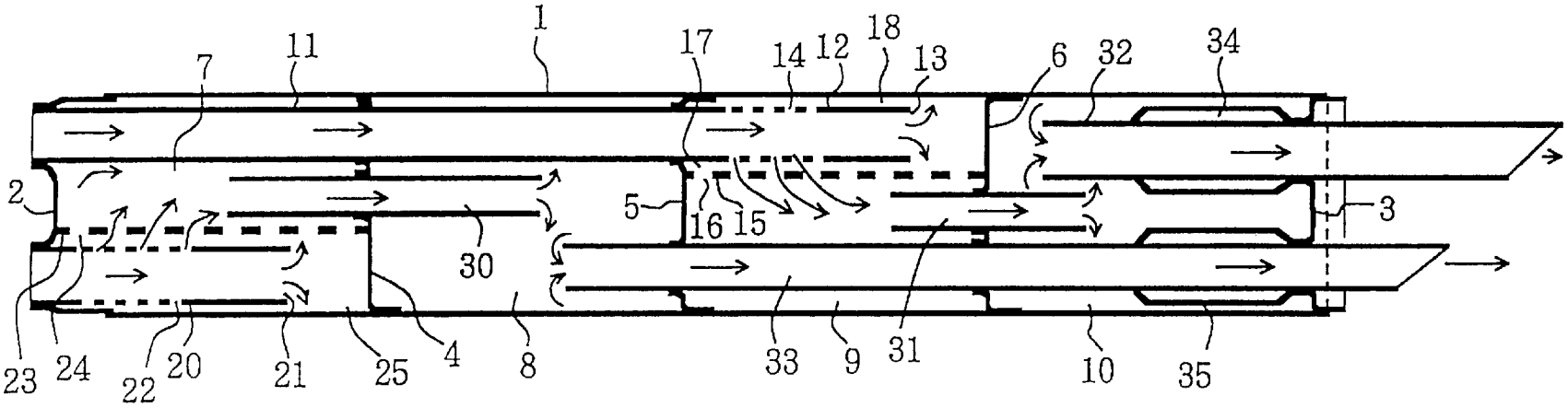
FIG. 1 is a schematic longitudinal section view showing the flow of exhaust gasses through the muffler of the present invention.

The muffler includes a cylindrical case 1, a front cap 2 arranged at a front end of the case 1, and an end cap 3 arranged at a rear end of the case 1. An inner side of the case 1 is constructed such that a first expansion chamber 7, a second expansion chamber 8, a third expansion chamber 9 and a fourth expansion chamber 10 are formed in this order by partition walls 4, 5 and 6 from an upstream side to a downstream side, respectively.

A first feeding pipe 11 connected to an exhaust pipe (not illustrated) passes through the front cap 2, the partition wall 4 and the partition wall 5. An end part 12 of the first feeding pipe 11 which is downstream from the partition wall 5 enters the third expansion chamber 9, and its outlet port 13 is opens into the third expansion chamber 9.

The end part 12 of the first feeding pipe 11 is formed, at its circumferential wall part, with many small holes 14. A first porous partition wall 15 is arranged substantially in parallel with the end part 12, thereby defining a fifth expansion chamber 17 within the third expansion chamber 9 and enclosing the first feeding pipe 11.

The first porous partition wall 15 is arranged to be connected between the forward partition wall 5 and the rearward partition wall 6. Many small holes 16 are formed on the entire surface of the first porous partition wall 15. Opposing ends of the first porous partition wall 15 are connected to the, partition wall 5 and the partition wall 6 in an axial direction of the first feeding pipe 11.

In addition, a second feeding pipe 20 connected to another exhaust pipe (not shown) passes through the front cap 2 and is arranged within the first expansion chamber 7. An outlet port 21 of the second feeding pipe 20 is positioned at an upstream side of the partition wall 4. Many small holes 22 are formed in the circumferential wall of the second feeding pipe 20.

A second porous partition wall 23 is arranged within the first expansion chamber 7 substantially in parallel with the second feeding pipe 20. A plurality of small holes 24 are formed in an entire surface of the second porous partition wall 24. Opposing ends of the second porous partition wall 24 are connected to the front cap 2 and the partition wall 4, thereby defining a sixth expansion chamber 25 within the first expansion chamber 7 and enclosing the second feeding pipe 20.

The first expansion chamber 7 and the second expansion chamber 8 communicate with each other by a first communicating pipe 30 passing through the partition wall 4. The third expansion chamber 9 and the fourth expansion chamber 10 communicate with each other by a second communicating pipe 31 passing through the partition wall 6.

The fourth expansion chamber 10 and the surrounding atmosphere communicate with each other by the first tail pipe 32 passing through the end cap 3. Similarly, the second expansion chamber 8 and the surrounding atmosphere communicate with each other by the second tail pipe 33 passing through the partition wall 5, the partition wall 6 and the end cap 3.

Muffler members 34, 35 are arranged in the fourth expansion chamber 10, and are fixed to the first tail pipe 32 and the second tail pipe 33, respectively.

Figure 2:
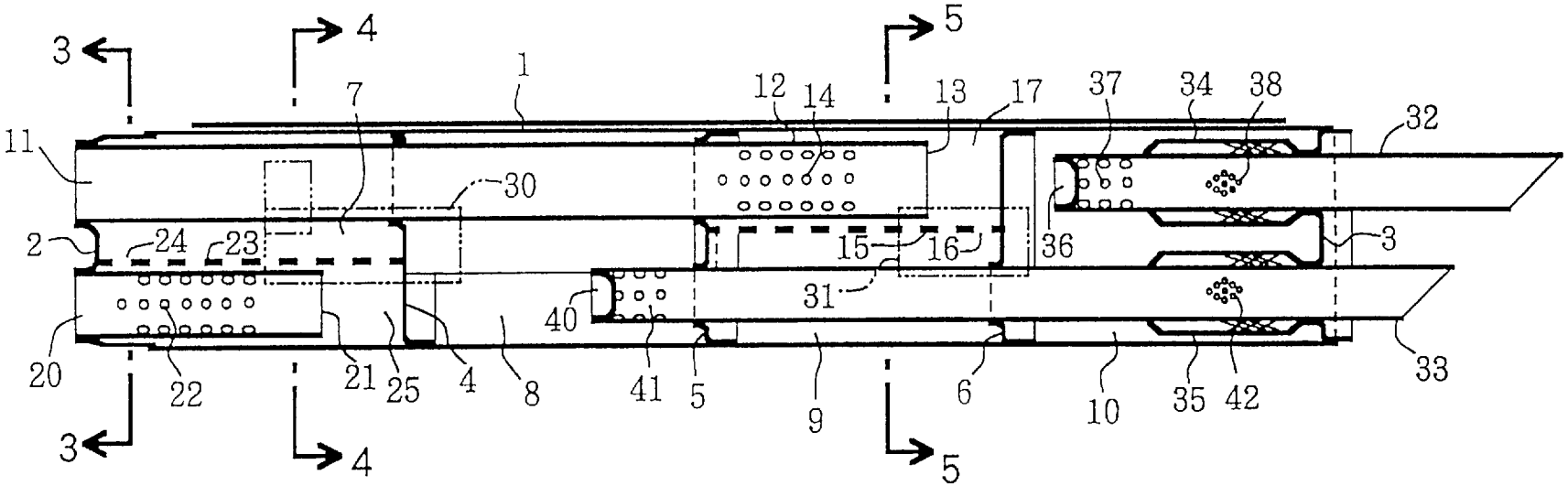
FIG. 2 is a longitudinal sectional view of the muffler.

As shown in FIG. 2, an upstream end of the first tail pipe 32 is closed by a cap 36, and its circumferential wall near the cap 36 is formed with many small holes 37. A portion of the first tail pipe 32 which is covered by the muffler member 34 is also formed with many small holes 38.

Further, the upstream end of the second tail pipe 33 is also closed by a cap 40, and its circumferential wall near the cap 40 is formed with many small holes 41. A portion of the second tail pipe 33 which is covered by the muffler member 35 is also formed with many small holes 42.

Figure 3:
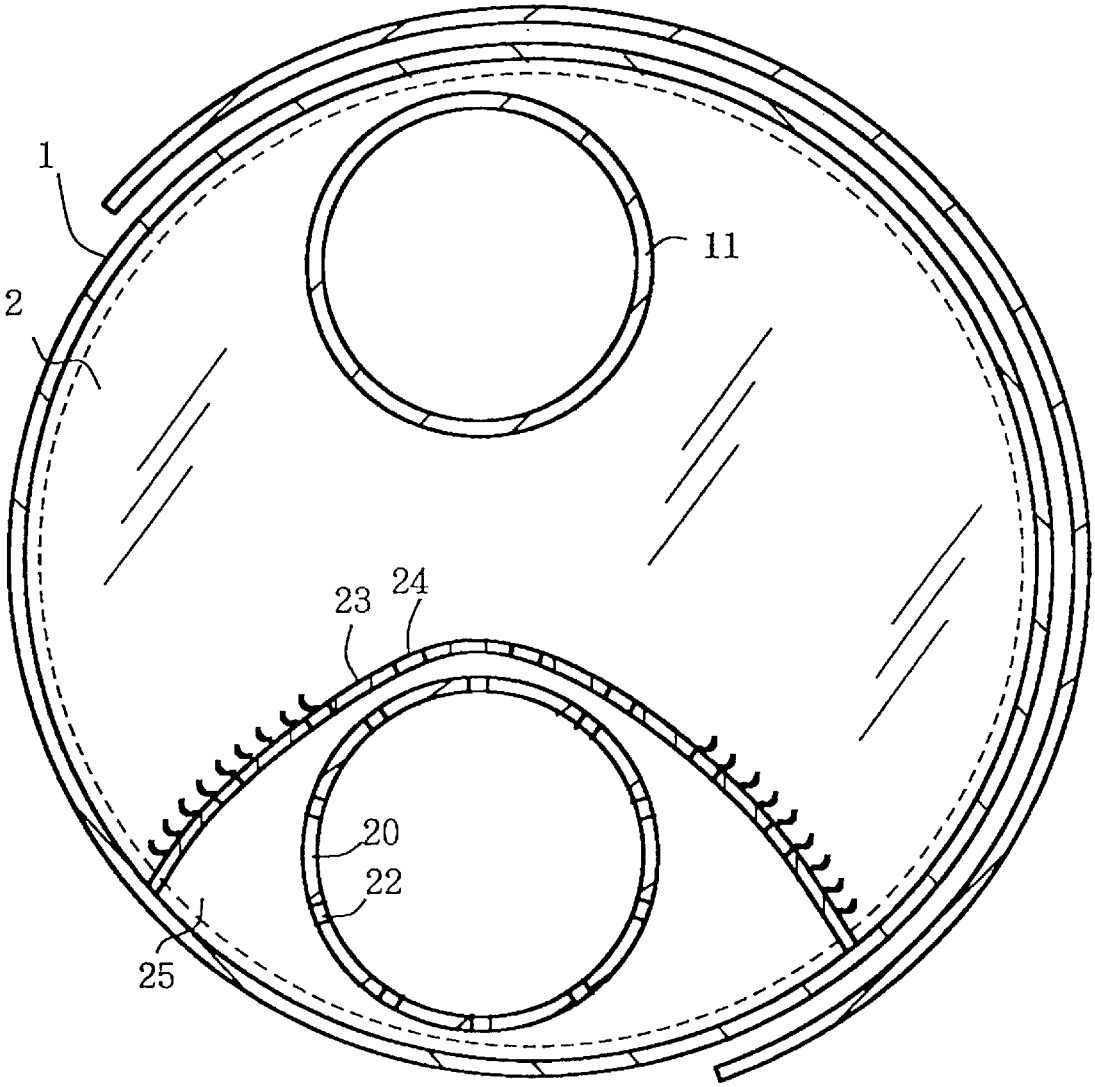
FIG. 3 is an enlarged sectional view taken along line 3—3 of FIG. 2.

Referring now to FIG. 3, the second porous partition wall 23 encloses the second feeding pipe 20 to form a substantially U-shaped convex curved member facing toward the central side of the case 1. The second porous partition wall 23 is welded to the front cap 2 and the partition wall 4.

Figure 4:
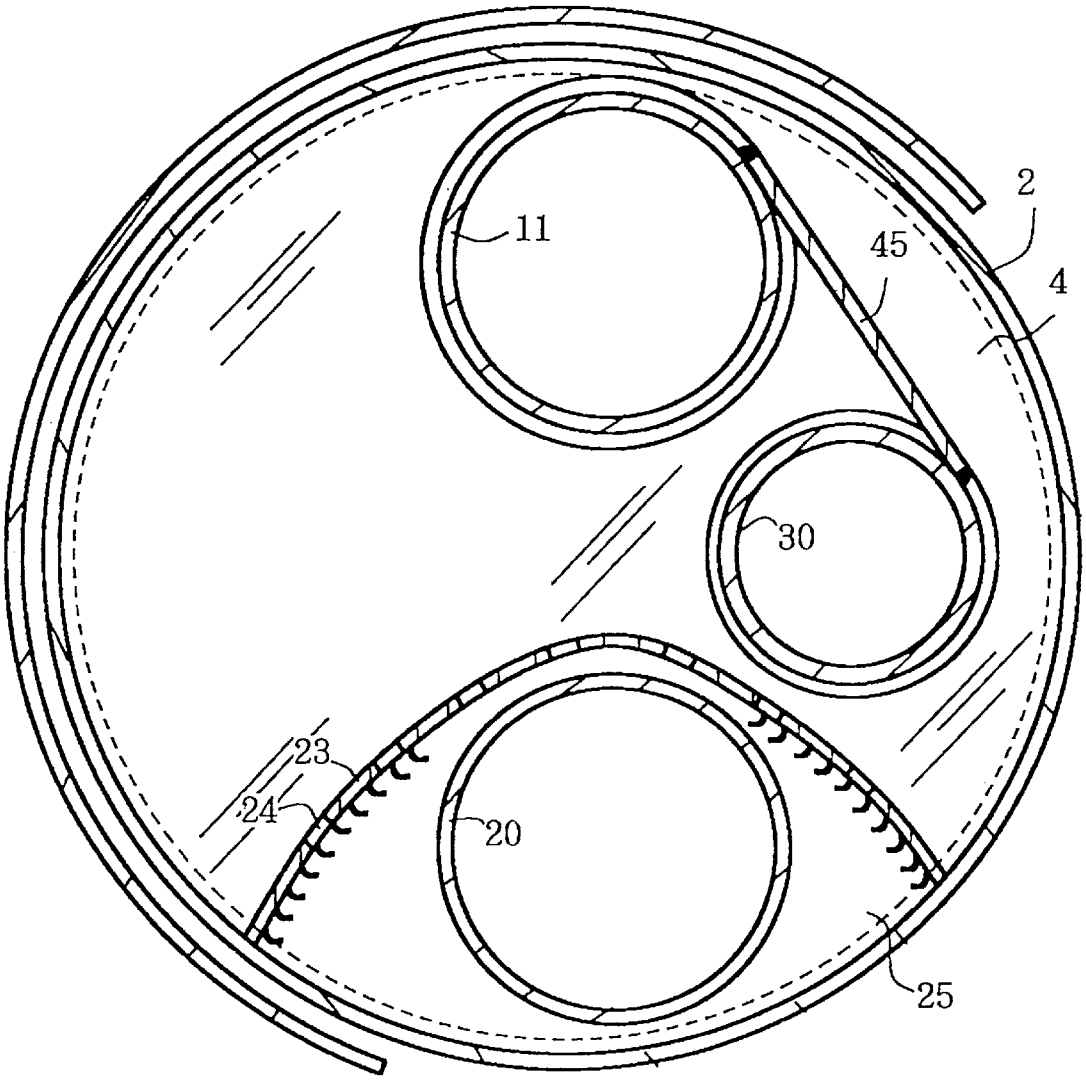
FIG. 4 is an expanded sectional view taken along line 4—4 of FIG. 2.

As shown in FIG. 4, the first communicating pipe 30 is connected to the first feeding pipe 11 by a bracket 45.

Figure 5:
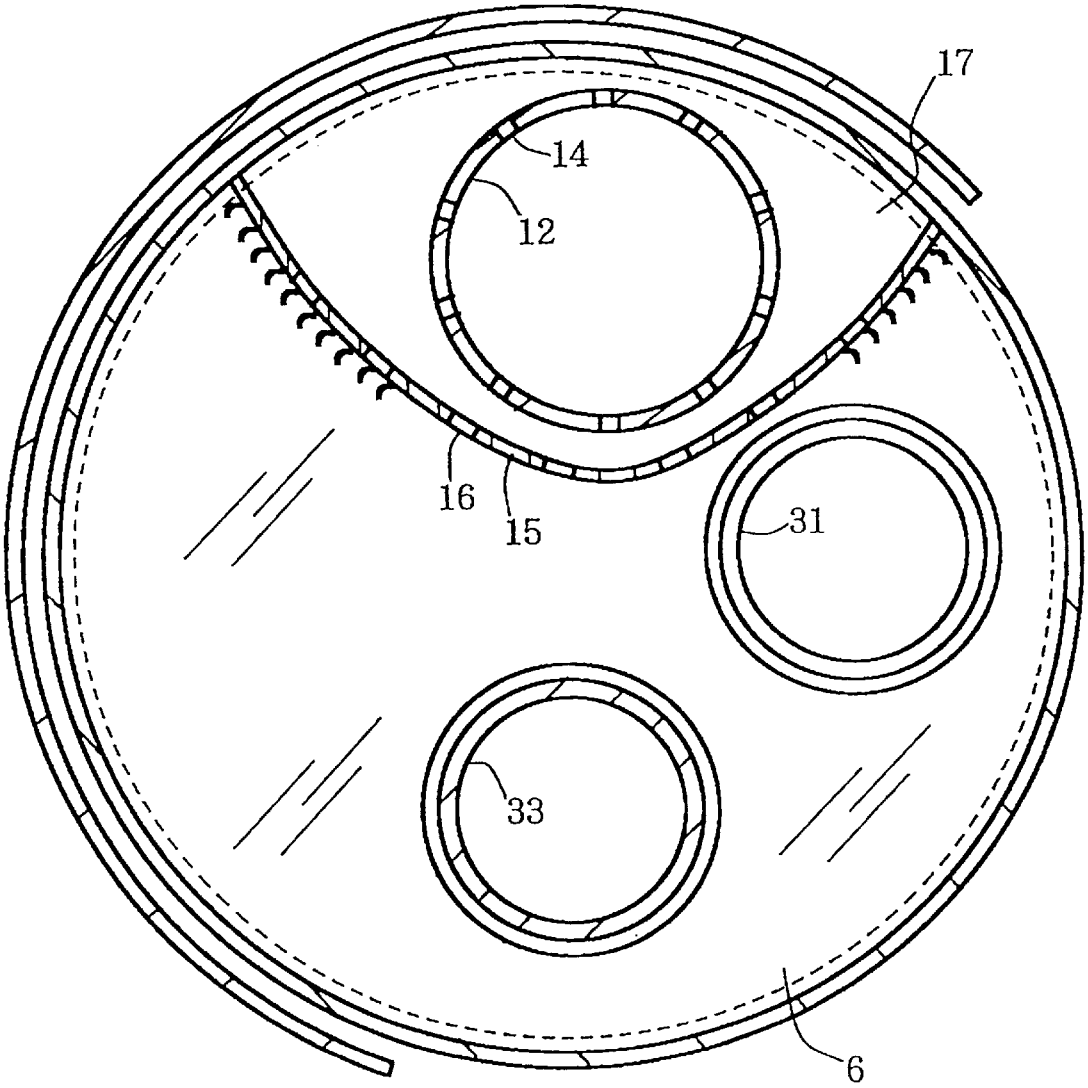
FIG. 5 is an enlarged sectional view taken along line 5—5 of FIG. 2.

Referring now to FIG. 5, the first porous partition wall 15 has the same shape as that of the second porous partition wall 23, and both ends of the first porous partition wall 15 are welded to the partition wall 6 and the partition wall 5.

Figure 6:
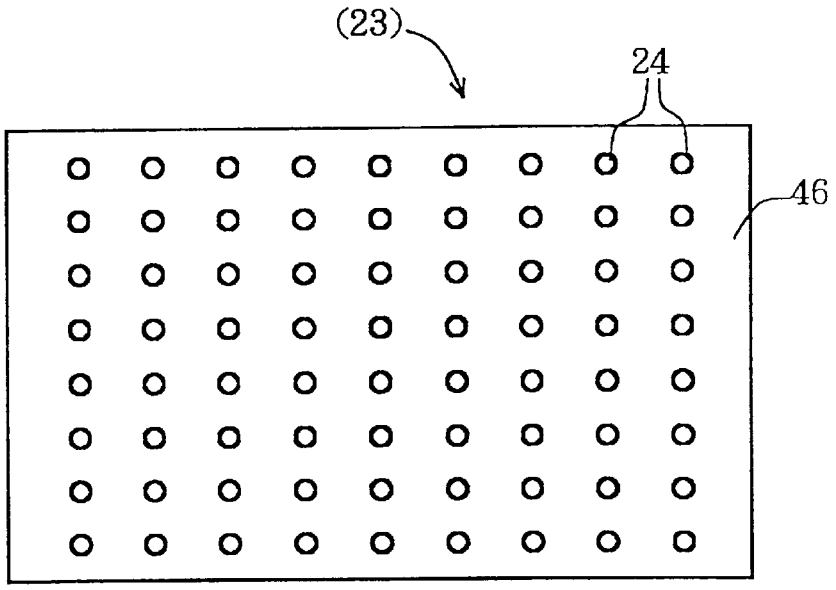
FIG. 6 is a view showing the porous partition wall.

Referring now to FIG. 6, the second porous partition wall 23 is formed as follows: a plurality of small holes 24 are punched into a flat plate of raw material to form a flat plate intermediate member 46, and subsequently it is press formed into a curved shape to become the second porous partition wall 23. Then, a recess is formed in the central part of the end portion of the side abutting against the front cap 2 so as to form a clearance between it and the front cap 2 during the welding operation. The first porous partition wall 15 is formed in a similar manner.

Operation of the preferred embodiment of the present invention will now be described, with reference to FIG. 1. Exhaust gas fed out of the first feeding pipe 11 is expanded from the outlet port 13 and the small holes 14 at the end part 12 into the fifth expansion chamber 17, and expanded through the small holes 16 of the first porous partition wall 15 into the third expansion chamber 9. The exhaust gas then flows from the third expansion chamber 9 into the second communicating pipe 31, and is expanded again within the fourth expansion chamber 10. The exhaust gas then passes through the first tail pipe 32 and is exhausted to the surrounding atmosphere.

Similarly, the exhaust gas within the second feeding pipe 20 is expanded from the outlet port 21 and the small holes 22 into the sixth expansion chamber 25, and expanded through the small holes 24 of the second porous partition wall 23 into the first expansion chamber 7. The exhaust gas then flows from the first expansion chamber 7 into the first communicating pipe 30, and the gas is expanded again within the second expansion chamber 8. The exhaust gas then passes through the second tail pipe 33 and is discharged to the surrounding atmosphere.

As described above, when the first porous partition wall 15 and the second porous partition wall 23 are arranged in a longitudinal direction of the muffler, it does not become necessary to arrange the porous partition wall on each of the extended lines of the first feeding pipe 11 and the second feeding pipe 20 with a distance more than a predetermined amount from the outlet port of each of the feeding pipes. Accordingly, the entire muffler can be made short in length and small in size.

Further, since the first porous partition wall 15 and the second porous partition wall 23 are merely arranged in parallel with the first feeding pipe 11 and the second feeding pipe 20, it is possible to simplify a shape of the porous partition wall. Even if the feeding pipe and the communicating pipe are overlapped with one another, it is not necessary to form the porous partition wall into a complex shape.

Still further, since it is not necessary that the first feeding pipe 11 and the second feeding pipe 20 pass through the first porous partition wall 15 and the second porous partition wall 23, and since it is not necessary that the first porous partition wall 15 and the second porous partition wall 23 be positioned on extended lines of them, it is possible to form the small holes 16, 24 on substantially the entire part of each of the porous partition walls, and an opening area of the small holes can be sufficiently assured.

Accordingly, irrespective of the fact that each of the aforesaid problems can be solved, the structure in the muffler is simplified and restriction in layout about each of the porous partition walls 15, 23, the feeding pipes 11, 20, the communicating pipes 30, 31 and the partition walls 4, 5 and 6 is reduced, resulting in that a degree of freedom in layout of the internal elements of the muffler is also increased.

Further, since each of the feeding pipes 11, 20 is enclosed by the first porous partition wall 15 and the second porous partition wall 23, each of the first porous partition wall 15 and the second porous partition wall 23 can be made relatively small in size. In addition, even in the case that a plurality of feeding pipes or communicating pipes or the like are present near it so as to have a certain restriction in arranging space, they may be installed in a relatively easy manner.

Also, since each of the first porous partition wall 15 and the second porous partition wall 23 is bent to form a convex shape toward the center of the muffler, these porous partition walls 15, 23 can be made smaller than before, and the spaces (the fifth expansion chamber 17 and the sixth expansion chamber 25) enclosed by the porous partition walls 15, 23 can be made as small as possible. In addition, they are curved, such that their arrangement in a narrow space becomes easier, and at the same time, rigidity is also increased, resulting in an improved anti-vibration characteristic.

Figure 7:
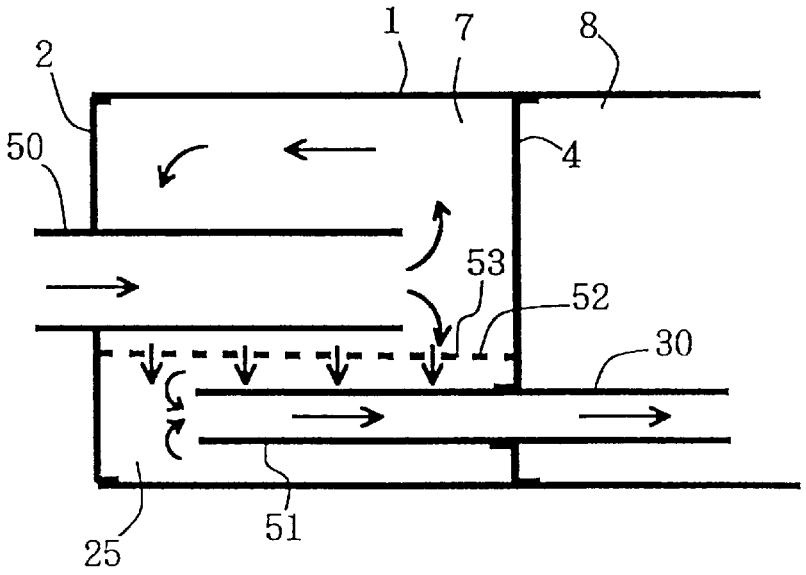
FIG. 7 is a partial schematic sectional view of another preferred embodiment of the present invention.

FIG. 7 is a schematic diagram showing another form of the invention. A feeding pipe 50 projecting into the first expansion chamber 7, and the end 51 of the first communicating pipe 30 upstream from the partition wall 4, are extended in a lengthwise direction to be overlapped with one another. Further, a porous partition wall 52 is arranged between the feeding pipe 50 and the upstream end 51. The porous partition wall 52 has a structure similar to that of the aforesaid second porous partition wall 23, wherein many small holes 53 are arranged to enclose either the upstream end 51 of the first communicating pipe 30 or the feeding pipe 50.

As described above, even where the constitution of the muffler is simplified and one feeding pipe 50 is installed, with the feeding pipe and the communicating pipe extending in a lengthwise direction to be overlapped, a complex shape of the porous partition wall 52 can be avoided.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A muffler comprising:

a housing having a first end and a second end;

a first partition wall extending laterally within said housing for longitudinally dividing an interior space of said housing into a first main chamber and a second main chamber;

a first porous wall member extending longitudinally within said first main chamber for laterally dividing said first main chamber into a first subchamber and a second subchamber;

a first communication tube passing through said first partition wall said first communication tube having a first end opening into said first subchamber and a second end opening into said second main chamber, said first communication tube extending substantially parallel to said first porous wall member; and a first inlet pipe extending longitudinally into said housing substantially parallel to said first porous wall member and said first communication tube, said first inlet pipe having an end opening into said second subchamber.

2. The muffler according to claim 1, wherein the first porous wall member is oriented substantially perpendicular to said first partition wall.

3. The muffler according to claim 1, wherein said first porous wall member is curved, with a concave portion thereof facing said first inlet pipe.

4. The muffler according to claim 1, wherein said first porous wall member has a plurality of holes therein.

5. The muffler according to claim 1, wherein said first inlet pipe has a plurality of holes in an outer periphery thereof opening into said second subchamber.

6. A muffler comprising:

a housing having a first end and a second end;

a first partition wall extending laterally within said housing for longitudinally dividing an interior space of said housing into a first main chamber and a second main chamber;

a first porous wall member extending longitudinally within said first main chamber for laterally dividing said first main chamber into a first subchamber and a second subchamber;

a first communication tube passing through said first partition wall and interconnecting said first subchamber with said second main chamber;

a first inlet pipe extending longitudinally into said housing substantially parallel to said first porous wall member and into said second subchamber; and a first outlet pipe opening into said second main chamber and extending out of said housing at said second end, wherein said first outlet pipe has a plurality of holes in an outer periphery thereof, and further comprising a muffling member surrounding said first outlet pipe adjacent said plurality of holes.

7. The muffler according to claim 6, wherein the first porous wall member is oriented substantially perpendicular to said first partition wall.

8. The muffler according to claim 6, wherein said first porous wall member is curved, with a concave portion thereof facing said first inlet pipe.

9. The muffler according to claim 6, wherein said first porous wall member has a plurality of holes therein.

10. The muffler according to claim 6, wherein said first inlet pipe has a plurality of holes in an outer periphery thereof opening into said second subchamber.

11. A muffler comprising:

a housing having a first end and a second end;

a first partition wall extending laterally within said housing for longitudinally dividing an interior space of said housing into a first main chamber and a second main chamber;

a first porous wall member extending longitudinally within said first main chamber for laterally dividing said first main chamber into a first subchamber and a second subchamber;

a first communication tube passing through said first partition wall and interconnecting said first subchamber with said second main chamber; and a first inlet pipe extending longitudinally into said housing substantially parallel to said first porous wall member and into said second subchamber, wherein the first porous wall member is oriented substantially perpendicular to said first partition wall, said first porous wall member being curved, with a concave portion thereof facing said first inlet pipe, said first porous wall member having a plurality of holes therein, and said first inlet pipe having a plurality of holes in an outer periphery thereof opening into said second subchamber, and further comprising a first outlet pipe opening into said second main chamber and extending out of said housing at said second end, said first outlet pipe having a plurality of holes in an outer periphery thereof, and a muffling member surrounding said first outlet pipe adjacent said plurality of holes.

12. A muffler comprising:

a housing having a first end and a second end;

first, second and third partition walls extending laterally within said housing for longitudinally dividing an interior space of said housing into a first main chamber, a second main chamber, a third main chamber and a fourth main chamber;

a first porous wall member extending longitudinally within said first main chamber for laterally dividing said first main chamber into a first subchamber and a second subchamber;

a second porous wall member extending longitudinally within said third main chamber for laterally dividing said third main chamber into a third subchamber and a fourth subchamber;

a first communication tube passing through said first partition wall and interconnecting said first subchamber with said second main chamber;

a second communication tube passing through said third partition wall and interconnecting said third subchamber with said fourth main chamber;

a first inlet pipe extending longitudinally into said housing substantially parallel to said first porous wall member and into said second subchamber; and a second inlet pipe extending longitudinally into said housing substantially parallel to said second porous wall member and into said fourth subchamber.

13. The muffler according to claim 12, wherein the first porous wall member is oriented substantially perpendicular to said first partition wall, and the second porous wall member is oriented substantially perpendicular to said second partition wall.

14. The muffler according to claim 12, wherein said first porous wall member is curved, with a concave portion thereof facing said first inlet pipe, and said second porous wall member is curved, with a concave portion thereof facing said second inlet pipe.

15. The muffler according to claim 12, wherein said first porous wall member has a plurality of holes therein, and said second porous wall member has a plurality of holes therein.

16. The muffler according to claim 12, further comprising a first outlet pipe opening into said second main chamber and extending out of said housing at said second end, and a second outlet pipe opening into said fourth main chamber and extending out of housing at said second end.

17. The muffler according to claim 16, wherein said first outlet pipe has a plurality of holes in an outer periphery thereof, and further comprising a muffling member surrounding said first outlet pipe adjacent said plurality of holes.

18. The muffler according to claim 16, wherein said second outlet pipe has a plurality of holes in an outer periphery thereof, and further comprising a muffling member surrounding said second outlet pipe adjacent said plurality of holes.

19. The muffler according to claim 12, wherein said first inlet pipe has a plurality of holes in an outer periphery thereof opening into said second subchamber, and wherein said second inlet pipe has a plurality of holes in an outer periphery thereof opening into said fourth subchamber.

20. The muffler according to claim 12, wherein said first inlet pipe, said second inlet pipe, said first outlet pipe, and said second outlet pipe all extend substantially parallel with one another.

* * * * *